US005816183A

United States Patent [19]

Braud et al.

[11] Patent Number: 5,816,183

[45] Date of Patent: Oct. 6, 1998

[54] SUBMERGED CALM BUOY

[75] Inventors: Jean Braud, La Turbie; Paul Anthony Brown, Nice, both of France; Geoffery O'Nion, Monte Carlo, Monaco

[73] Assignee: Single Buoy Moorings Inc., Marly, Switzerland

[21] Appl. No.: 809,966

[22] PCT Filed: Oct. 7, 1994

[86] PCT No.: PCT/EP94/03342

§ 371 Date: Mar. 31, 1997

§ 102(e) Date: Mar. 31, 1997

[87] PCT Pub. No.: WO96/11134

PCT Pub. Date: Apr. 18, 1996

[51] Int. Cl.[6] ..... B63B 21/52

[52] U.S. Cl. ..... 114/230; 441/4

[58] Field of Search ..... 441/3–5; 114/293, 114/230

[56] References Cited

U.S. PATENT DOCUMENTS

| | | | |
|---|---|---|---|
| 3,750,723 | 8/1973 | Schirtzinger | 441/5 |
| 4,516,942 | 5/1985 | Pedersen | 441/5 |
| 5,288,253 | 2/1994 | Urdshals et al. | 441/5 |

FOREIGN PATENT DOCUMENTS

| | | | |
|---|---|---|---|
| 2 344 442 | 10/1977 | France . | |
| 2752266 | 5/1979 | Germany | 114/230 |
| 1 509 909 | 5/1978 | United Kingdom . | |
| 2 050 995 | 1/1981 | United Kingdom . | |
| 2 244 463 | 12/1991 | United Kingdom . | |
| 2 269 351 | 2/1994 | United Kingdom . | |
| 2 273 087 | 6/1994 | United Kingdom . | |

*Primary Examiner*—Ed L. Swinehart
*Attorney, Agent, or Firm*—Young & Thompson

[57] ABSTRACT

A Catenary Anchor Leg Mooring (CALM) buoy (1) comprises a body (2) with buoyancy, elements (3) for connecting the buoyant body to catenary anchor chains to anchor the body to the seabed, a turntable (5) rotatable elements with respect to the body with buoyancy. The turntable has devices (6, 6') for a floating unit such as a vessel, a swivel and elements for connecting at least one hose (8, 8') between at least one swivel and a submerged pipe structure extending over or into the seabed to any subsea well or the like, as well as elements for connecting at least one hose (9) between at least one swivel and at least one vessel (7), wherein the CALM buoy is provided with catenary anchor chains (4) which have a weight such that the CALM buoy as a whole is kept underwater at least during normal practice.

5 Claims, 3 Drawing Sheets

SUBMERGED CALM BUOY

The invention relates to a Catenary Anchor Leg Mooring (CALM) buoy comprising a body with buoyancy, means for connecting the buoyant body to catenary anchor chains to anchor the body to the seabed, a turntable being rotatable with respect to the body with buoyancy, said turntable having mooring means for a floating unit such as a vessel, a swivel and means for connecting at least one hose between at least one swivel and a submerged pipe structure extending over or into the seabed to any subsea well or the like, as well as means for connecting at least one hose between at least one swivel and at least one vessel.

A CALM buoy serves for mooring a floating unit, such as a vessel, and for connecting said floating unit to a submerged pipe structure extending over or into the seabed to any subsea well or the like.

BACKGROUND OF THE INVENTION

CALM buoys are well known as being buoys with buoyancy floating at sea level. Because of said floating at sea level the CALM buoys are affected by severe loads caused by forces exerted upon the hawser lines by the vessel floating to and from the buoy forces exerted on the means connecting the buoy with the vessel, and forces exerted upon the catenary chains anchoring the buoy to the seabed, by the action of waves to the buoyant body of the buoy. As a rule they have own stability and therefore volume.

To connect floating units, such as vessels, to a mooring buoy and to a submerged pipe structure extending over or into the seabed to any subsea well or the like, several proposals are known from the prior art.

To solve the problems of these forces U.S. Pat. No. 3,823,432 and U.S. Pat. No. 3,908,212 both disclose a single point mooring buoy having a buoyant body which is small with respect to the floating unit, and around which the floating unit can weathervane. The vessel and buoy are interconnected by a rigid arm. The arm has a horizontally disposed hinge interconnecting the floating unit and the buoyant body so that they can achieve an angular displacement at need with respect to each other in a vertical common plane of symmetric. The size and thereby the mass of the buoyant body is chosen so that it offers very little resistance to the action of waves thereon. Vividly the mooring buoy will follow the motions of the floating unit as well as the motions of the sea surface.

However, the amplitude and frequency of the primarily cyclic motions of the floating unit and the sea surface differ substantially from one another. Such different motions may result in heavy loads exerted on the catenary anchor lines as well as the hinge mentioned above.

The above mentioned known arrangements of a small buoy which by means of a rigid arm is held by the vessel like a barrow, does already reduce said loads under the majority of circumstances. However, it may occur that the combination of forces on one hand of the vessel through arm and buoy on part of the catenary lines, in particular if already drifted away from its proper location, and on the other hand of the waves leads to unexpected overloads. These loads appear to be that heavy that the maximum allowable tensions in the catenary anchor lines and in the hinge will be exceeded easily causing line failure and breaking of the pivot respectively.

Alternatively, large semi-submersible mooring buoys are known, for instance from U.S. Pat. No. 4,784,079. Such large structures are particularly indifferent to the motions of the sea surface because of their size being relatively large in view of the amplitude of the waves. These structures are indifferent also to the motions of a vessel interconnected thereto because of their size and mass which may be equal or even larger than those of said vessel. In U.S. Pat. No. 4,784,079 a rather complex structure for interconnecting the buoyant body and the vessel is shown, primarily to cope with the motions of the floating unit relative to the buoyant body. Said large structures involve high cost to produce and to maintain these structures.

U.S. Pat. No. 4,617,000 discloses a much smaller buoy not being connected rigidly to a vessel, comprising a buoyant body with anchoring chains, a turntable on said body with a mooring for a vessel. According to said publication the turntable has buoyancy as well and preferably takes part in the water displacement of the buoy. The bearing between turntable and body is preferably above sealevel between a central sleeve of the body and the turntable, accessible from above and located in the line from mooring point on the turntable to chain stopper on the body. The buoy disclosed is a semi-submersible buoy.

The structure disclosed in U.S. Pat. No. 4,617,000 is particularly affected as well by the motions of the sea surface because of its size being relatively less or equal in view of the amplitude of the waves, and the motions of the vessel interconnected thereto because of its size and mass being essentially less or equal in view of those of said vessel.

Such affections may still lead to unexpected overload of the anchor lines or connecting arm. In practice said loads appear to be that heavy that the maximum allowable tensions in the catenary anchor lines as well as in the connecting arm or hinge interconnecting said arm to the buoy, will be exceeded easily causing line failure and breaking of the arm or pivot respectively.

The object of the invention is to minimize the loads exerted on both the catenary anchor lines and the mooring means caused by the motions of the sea surface and the floating unit relative to the buoyant body.

SUMMARY OF THE INVENTION

According to the invention the Catenary Anchor Leg Mooring (CALM) buoy comprising a body with buoyancy, means for connecting the buoyant body to catenary anchor chains to anchor the body to the seabed, a turntable being rotatable with respect to the body with buoyancy, said turntable having mooring means for a floating unit such as a vessel, a swivel and means for connecting at least one hose between at least one swivel and a submerged pipe structure extending over or into the seabed to any subsea well or the like, as well as means for connecting at least one hose between at least one swivel and at least one vessel, is characterized in that the catenary anchor chains which have a weight such that the CALM buoy as a whole is kept underwater at least during normal practice.

According to a further aspect of the invention the catenary anchor chains have a weight such that the CALM buoy extends to no more than at least one time the depth of a keel of a current vessel or the like, below current sea level while rising from seabed toward sea level.

Accordingly, contrary to normal practice and opinions the fully equiped buoy is positioned below water level, preferably far below it. This has a number of advantages. Primarily the buoy is no longer subjected to the forces of the waves.

For small floats this is well known but no expert ever thought about the question whether a mooring buoy of the described type could be placed below water level because of the need to service it.

Furthermore this allows positioning of the buoy in the line of forces from the vessel towards the anchor or anchors at the particular site which is more favourable under all conditions and water depths. This new position allows for a different design, in particular with respect to its magnitude because wind and wave forces on the buoy no longer exist.

According to a further aspect of the invention the turntable is detachably connected to the body with buoyancy. This may be a quick release coupling with guide means to allow servicing of the swivel and bearings.

According to a further aspect of the invention the mooring means are equipped with flotation means.

According to a further aspect of the invention the mooring means may be lengthened such that when rising essentially in upright position from the buoyant body toward sea level, said means extends to just below or just above sea level, so that a connection can easily be made.

According to a further aspect of the invention the mooring means is a rigid arm which comprises at the buoyant end a pivotal connection to the buoy and at the other end means for connecting a mooring hawser thereto.

To minimize the loads exerted on both the catenary anchor lines and the hinge caused by the motions of the sea surface the mooring buoy is preferably configured as a submerged mooring buoy. The CALM buoy according to the present invention is particularly suited not to be affected by the action of waves thereon. Hereby the loads exerted on the catenary anchor lines connecting the CALM buoy to the seabed are minimized.

The vessel must be able to weathervane around the mooring buoy and to this end the CALM buoy comprises two parts, being rotatable relative to each other. For sake of simplified serviceability one of said parts can be disconnected from the other part to easily elevate the disconnected part to above sea level.

BRIEF DESCRIPTION OF THE DRAWINGS

The invention will be further elucidated referring to an embodiment of the invention shown in the drawings, wherein.

DETAILED DESCRIPTION OF THE INVENTION

Figure 1:
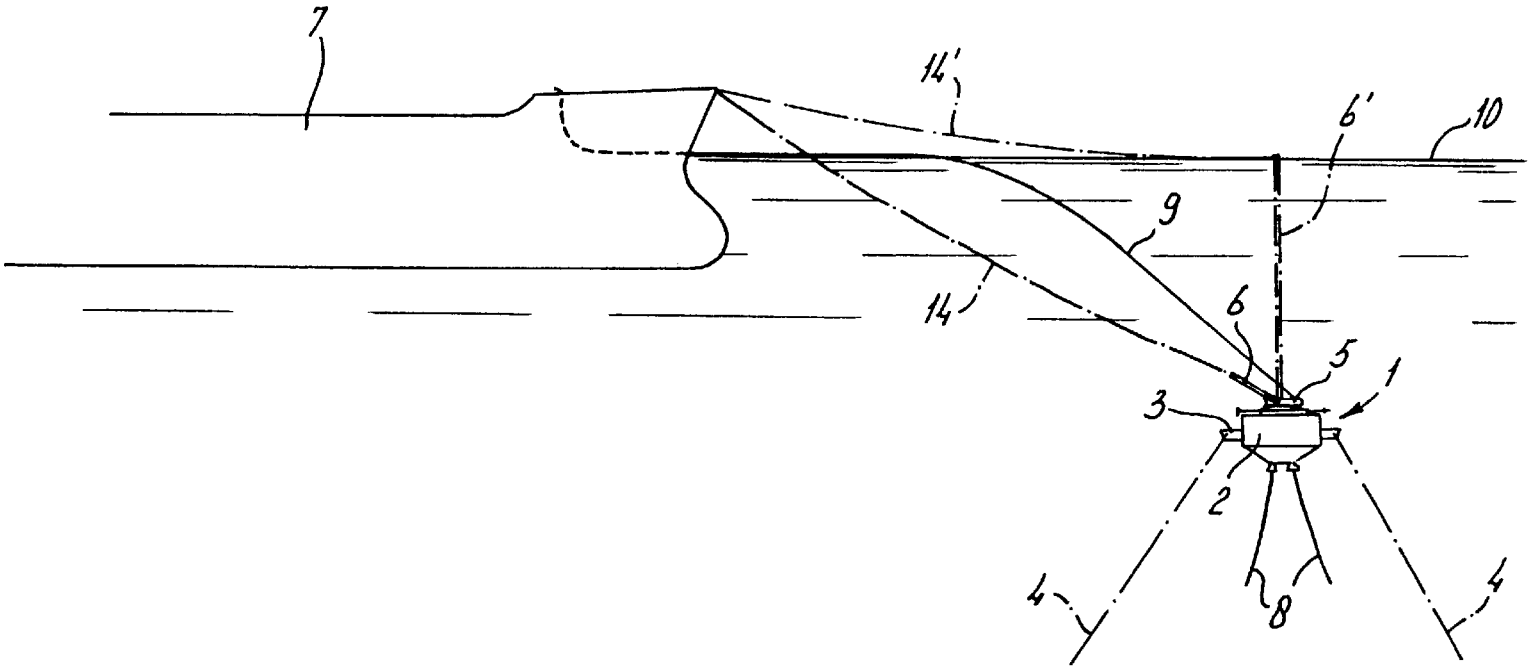
FIG. 1 shows an embodiment of the invention in side view.

In FIG. 1 a CALM buoy 1 is shown floating below sea level 10, anchored by catenary anchor lines 4 to a seabed, wherein a vessel 7 is connected to mooring means 6, 6' of the buoy by a mooring hawser 14, 14' and to a swivel (not shown) by a hose 9 connected at its other end to a bow coupler (not shown) at the vessel 7.

The CALM buoy comprises a buoyant body 2 forcing the buoy to rise toward sealevel. The buoy is kept underwater by the catenary anchor lines 4 having a suitable weight as to withhold the buoy to float at sea level 10. The buoyant body 2 of the CALM buoy 1 comprises means 3 such as chain tables for connecting said buoyant body to the catenary anchor chains 4.

Further, the CALM buoy 1 comprises a turntable 5 comprising mooring means 6, 6', for example, a rigid arm which comprises at the buoyant end a pivotal connection 11 to the turntable 5 and at the other end means for connecting a mooring hawser 14 thereto.

As mentioned, a hose 9 extending from the vessel 7 is connected to one end of the swivel of the CALM buoy 1. At the other swivel end hoses 8 are connected to extend between the swivel and a submerged pipe structure extending over or into the seabed to any subsea well or the like.

Figure 2:
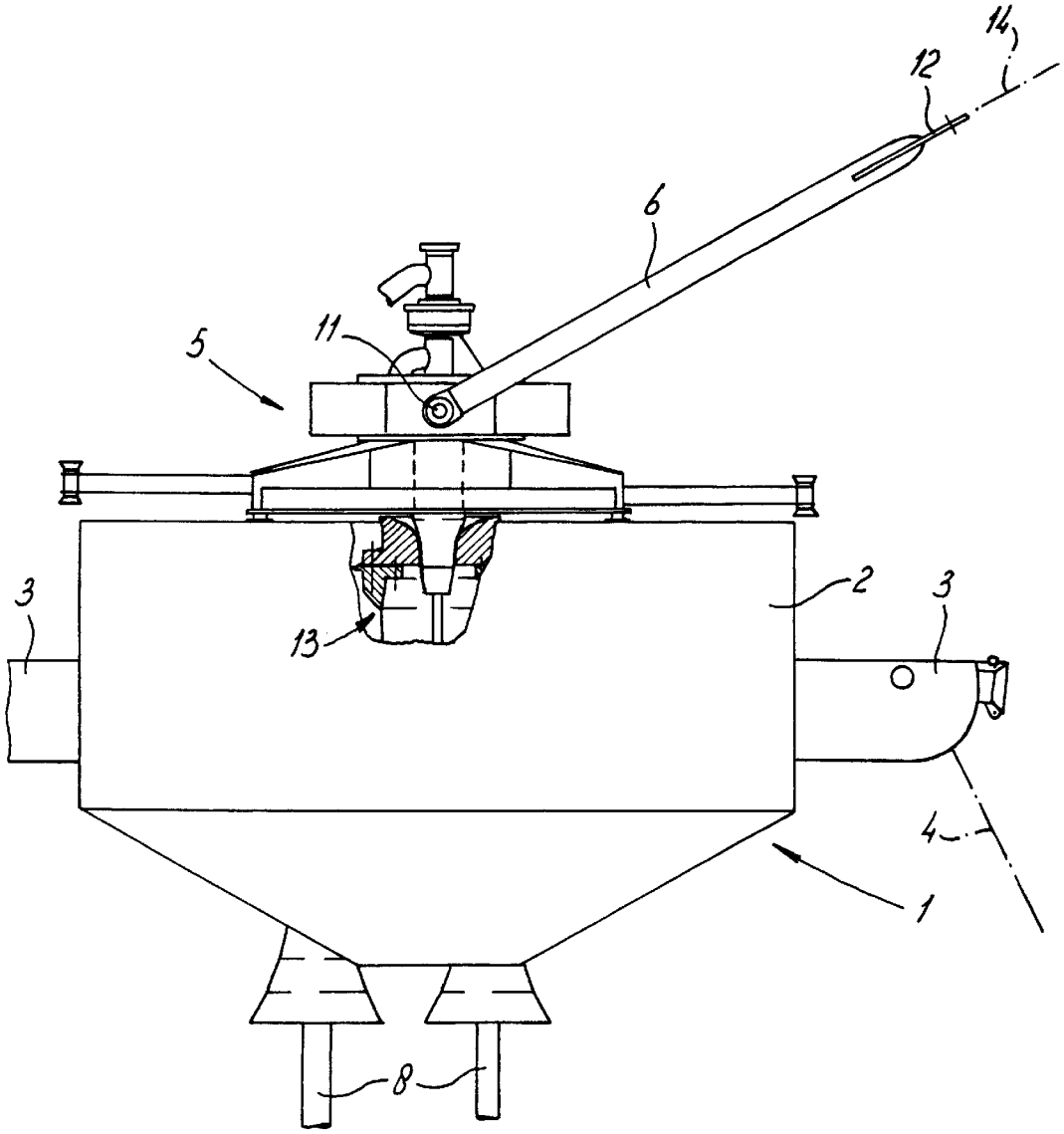
FIG. 2 shows on an enlarged scale the CALM buoy from FIG. 1 in side view.

In FIG. 2 the CALM buoy 1 from FIG. 1 is shown on an enlarged scale. The CALM buoy 1 comprises a buoyant body 2, means 3 for connecting said buoyant body to the catenary anchor chains 4, a turntable 5 comprising mooring means 6, 6' and means 12 for connecting a mooring hawser 14, 14' to said mooring means 6, 6', and a pivotal connection 11 to connect the mooring means 6, 6' to the structure of the turntable 5.

Further the CALM buoy 1 comprises a connection means 13 for detachably connecting the turntable 5 to the buoyant body 2. The connection means 13 are provided for sake of simplified serviceability.

As can be seen from FIG. 2, the CALM buoy 1 is connected to a mooring hawser 14 by means 12, and to a catenary anchor chain 4 by means 3.

Figure 3:
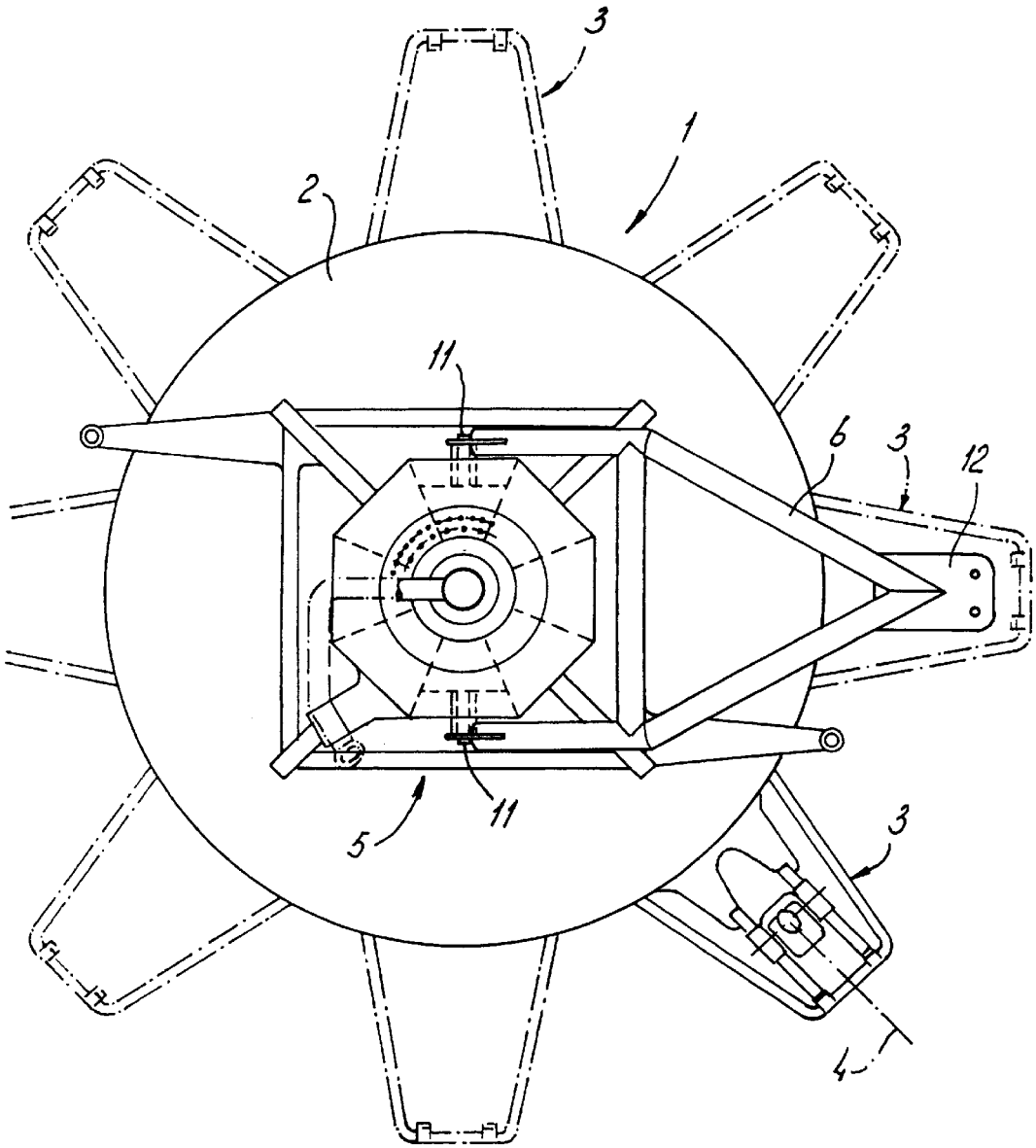
FIG. 3 shows the CALM buoy from FIG. 2 in plan view.

In FIG. 3 the CALM buoy 1 from FIG. 2 is shown with the reference signs indicating the same elements as shown in FIG. 2.

Although the embodiment according to FIGS. 1 to 3 is most preferred at the time being, it will be immediately clear that a lot of amendments can be introduced without leaving the scope of protection. These and other amendments which are obvious for the persons skilled in the art do not restrict the scope of protection of the application.

We claim:

1. A catenary anchor leg mooring buoy comprising a buoyant body, means for connecting the buoyant body to catenary anchor lines for anchoring the body to the seabed, the catenary anchor lines having a weight such that the buoy as a whole is kept underwater when the anchor lines are attached to the seabed, the buoy further comprising a turntable which is rotatable with respect to the buoyant body, said turntable having a rigid mooring arm for connection to a floating vessel via an anchor line or chain and for exerting a rotational moment on the turntable upon weathervaning of the vessel around the buoy, said mooring arm having a relatively short length such that when in an essentially upright position from the buoyant body toward sea level, the mooring arm extends no further than to just below or just above the sea level, a swivel and means for connecting at least one hose between the swivel and a submerged pipe structure extending over or into the seabed to any subsea well, and means for connecting at least one hose between the swivel and the floating vessel.

2. Catenary anchor leg mooring buoy according to claim 1, wherein the weight of the catenary anchor lines is such that the buoy extends to at least one time the depth of a keel of the floating vessel below the sea level.

3. Catenary anchor leg mooring buoy according to claim 1, wherein the turntable is detachably connected to the buoyant body.

4. Catenary anchor leg mooring buoy according to claim 3, wherein the mooring arm is equipped with floatation means.

5. Catenary anchor leg mooring buoy according to claim 4, wherein the mooring arm has a buoyant end and a second end, a pivotal connection connecting the buoyant end to the buoy, and means for connecting a mooring hawser to the second end.

* * * * *